US010231539B1

(12) United States Patent
Lu

(10) Patent No.: US 10,231,539 B1
(45) Date of Patent: Mar. 19, 2019

(54) TABLE CABINET HAVING POWER-DRIVEN LIFTING SOCKET AND POWER-DRIVEN LIFTING SOCKET

(71) Applicant: Dong Guan Song Wei Electric Technology Co., Ltd., Dongguan, Guangdong (CN)

(72) Inventor: Min-Hsun Lu, Dongguan (CN)

(73) Assignee: DONG GUAN SONG WEI ELECTRIC TECHNOLOGY CO., LTD., Dongguan, Guangdong (CN)

( * ) Notice: Subject to any disclaimer, the term of this patent is extended or adjusted under 35 U.S.C. 154(b) by 0 days.

(21) Appl. No.: 15/835,481

(22) Filed: Dec. 8, 2017

(51) Int. Cl.

| | |
|---|---|
| ***A47B 83/04*** | (2006.01) |
| ***H01R 25/00*** | (2006.01) |
| ***H01R 13/447*** | (2006.01) |
| ***H01R 13/66*** | (2006.01) |

(52) U.S. Cl.
CPC ..... *A47B 83/045* (2013.01); *H01R 13/447* (2013.01); *H01R 13/66* (2013.01); *H01R 25/006* (2013.01); *A47B 2200/008* (2013.01)

(58) Field of Classification Search
CPC .... A47B 83/045; H01R 13/66; H01R 25/006; H01R 13/447
USPC ..... 174/500, 53
See application file for complete search history.

(56) References Cited

U.S. PATENT DOCUMENTS 5,954,525 A * 9/1999 Siegal ..... A47B 21/06 312/223.6

* cited by examiner

*Primary Examiner* — Dhiru R Patel
(74) *Attorney, Agent, or Firm* — Leong C. Lei

(57) ABSTRACT

A table cabinet having a power-driven lifting socket and a power-driven lifting socket are provided. The power-driven lifting socket includes a housing, a control board, a socket main body, and a lifting device. The socket main body can be driven by the lifting device to move up and down so as to extend out of a passage or retract into the passage. The socket main body may ascend or descend according to the need of use. When not in use, the socket main body can be hidden, such that the surface of the table cabinet is tidy and beautiful, and the socket main body won't be contaminated by the dust, thereby ensuring the performance for the socket.

9 Claims, 8 Drawing Sheets

TABLE CABINET HAVING POWER-DRIVEN LIFTING SOCKET AND POWER-DRIVEN LIFTING SOCKET

BACKGROUND OF THE INVENTION

1. Field of the Invention

The present invention relates to a socket and a table cabinet, and more particularly to a table cabinet having a power-driven lifting socket and a power-driven lifting socket.

2. Description of the Prior Art

A socket is an essential household article, which may be set on a table cabinet for the use of an electrical appliance. In the prior art, the socket is set on the surface of the table cabinet, so the socket is exposed to the outside. The overall appearance of the table cabinet is unpleasant, and the socket is easily contaminated with dust to affect its performance for use. Besides, children may touch the socket, resulting in a security risk. Therefore, it is necessary to improve the conventional socket.

SUMMARY OF THE INVENTION

In view of the shortcomings of the prior art, the primary object of the present invention is to provide a table cabinet having a power-driven lifting socket and a power-driven lifting socket. The present invention can effectively solve the problems that the conventional sockets are easily contaminated with dust and the table cabinet is unsightly.

According to one aspect of the present invention, a power-driven lifting socket is provided. The power-driven lifting socket comprises a housing, a control board, a socket main body, and a lifting device. The housing includes a base and a flip-open cover. The base has a passage with an opening facing upward. The flip-open cover is mounted on a top of the base and configured to cover the opening at an upper end of the passage. The control board is disposed at a bottom of the base. The socket main body is disposed in the passage and movable up and down. The lifting device is disposed in the passage. The lifting device drives the socket main body to move up and down so as to extend out of the passage or retract into the passage. The lifting device is electrically connected to the control board.

Preferably, the lifting device includes a rack, a motor, and a gear. The rack is fixed to the socket main body and extends downward. The motor is fixed in the passage. The motor is electrically connected to the control board. The gear is mounted on an output shaft of the motor. The gear is engaged with the rack.

Preferably, the lifting device includes two lifting devices arranged left and right. The racks of the two lifting devices are fixedly connected to a bottom of two ends of the socket min body, respectively.

Preferably, the motor is one of a stepper motor, a synchronous motor and a direct current motor.

Preferably, the housing is provided with a protection device for preventing a user's hand from being pressed. The protection device is electrically connected to the control board.

Preferably, the protection device includes an infrared sensor. The infrared sensor is disposed at a lower portion of the socket main body or a lower portion of a socket mounting port.

Preferably, a bottom of the socket main body is provided with a support post. The socket main body is connected with a power cord. The power cord is partially hidden in the support post.

Preferably, the socket main body has a mains electricity supply interface and/or a USB charging interface.

According to another aspect of the present invention, a table cabinet having a power-driven lifting socket is provided. The table cabinet comprises a table cabinet main body and the aforesaid power-driven lifting socket. A surface of the table cabinet main body is recessed to form a mounting trough. The power-driven lifting socket is disposed in the mounting trough. In a lifting state, the socket main body opens the flip-open cover and extends out of the surface of the cabinet main body. In a hidden state, the flip-open cover covers the socket main body and is flush with the surface of the table cabinet main body.

Preferably, the table cabinet main body is made of a wood, plastic or metal material. A front of the table cabinet main body is provided with a door that can be opened and closed. Other sides of the table cabinet main body are hermetically disposed.

Compared with the prior art, the present invention has obvious advantages and beneficial effects. Specifically, it can be seen from the above technical solution:

The socket main body can be driven by the lifting device to move up and down so as to extend out of the passage or retract into the passage. The socket main body may ascend or descend according to the need of use. When not in use, the socket main body can be hidden, such that the surface of the table cabinet main body is tidy and beautiful, and the socket main body won't be contaminated by the dust, thereby ensuring the performance for the socket. Besides, children can be prevented from touching and the potential safety hazard can be eliminated, which brings convenience to users.

DETAILED DESCRIPTION OF THE PREFERRED EMBODIMENTS

Figure 1:
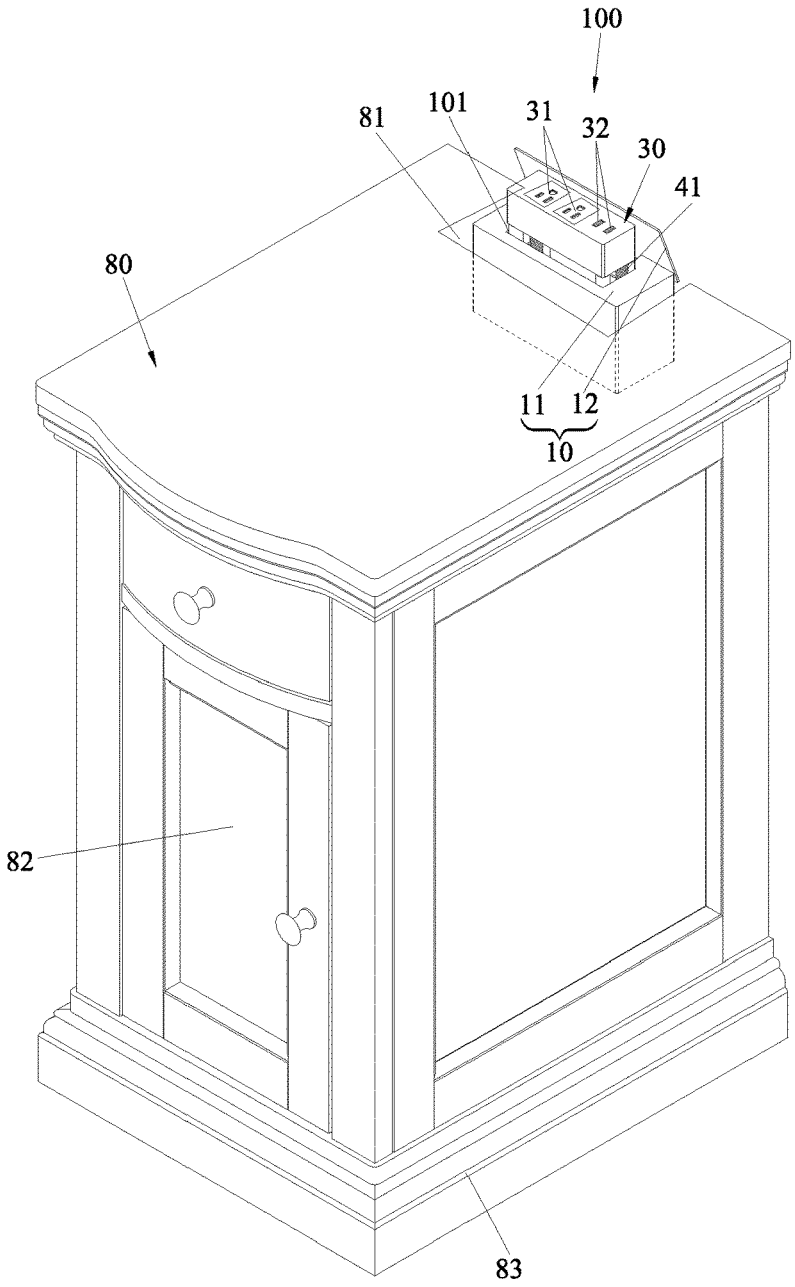
FIG. 1 is a perspective view of the table cabinet according to a preferred embodiment of the present invention.

Embodiments of the present invention will now be described, by way of example only, with reference to the accompanying drawings.

Referring to FIG. 1 to FIG. 8, there is shown a specific structure of a preferred embodiment of the present invention. A power-driven lifting socket 100 includes a housing 10, a control board 20, a socket main body 30 and a lifting device 40.

The housing 10 includes a base 11 and a flip-open cover 12. The base 11 has a passage 101 with an opening facing upward. The flip-open cover 12 is mounted on the top of the base 11 so as to cover the opening at the upper end of the passage 101. In this embodiment, the base 11 has a fixing ear 102 extending outward. The fixing ear 102 has a fixing hole 103 to facilitate installation and fixing. The color of the flip-open cover 12 may be a wood color, multi-color or single color. It would be better to match the surrounding color of the flip-open cover.

The control board 20 is disposed at the bottom of the base 11. The control board 20 includes a motor driving circuit, an infrared sensing circuit, and an MCU integrated signal processing circuit. In this embodiment, the control board 20 is suspended under the outer bottom of the base 11. The control board 20 is provided with a driving power supply and is connected to a lift control button 50.

The socket main body 30 is disposed in the passage 101 and can be moved up and down. In this embodiment, the bottom of the socket main body 30 is provided with a support post 61. The socket main body 30 is connected with a power cord 62. The power cord 62 is partially hidden in the support post 61. Moreover, the socket main body 30 has a mains electricity supply interface 31 and/or a USB charging interface 32.

The lifting device 40 is disposed in the passage 101. The lifting device 40 drives the socket main body 30 to move up and down so as to extend out of the passage 101 or retract into the passage 101. The lifting device 40 is electrically connected to the control board 20. Specifically, the lifting device 40 includes a rack 41, a motor 42 and a gear 43. The rack 41 is fixed to the socket main body 30 and extends downward. The motor 42 is fixed in the passage 101. The motor 42 is electrically connected to the control board 20. The gear 43 is mounted on an output shaft of the motor 42. The gear 43 is engaged with the rack 41. In this embodiment, there are two lifting devices 40 arranged left and right. The racks 41 of the two lifting devices 40 are fixedly connected to the bottom of the two ends of the socket min body 30, respectively. The motor 42 is a stepper motor, a synchronous motor or a direct current motor.

The housing 10 is provided with a protection device 70 for preventing the finger from being pressed during the lifting process. The protection device 70 is electrically connected to the control board 20. The protection device 70 includes an infrared sensor 71. The infrared sensor 71 is disposed at a lower portion of the socket main body 30 or a lower portion of a socket mounting port. One or more infrared sensors 71 are provided. The infrared sensor 71 outputs a signal feedback to the MCU of the control board 20.

Figure 2:
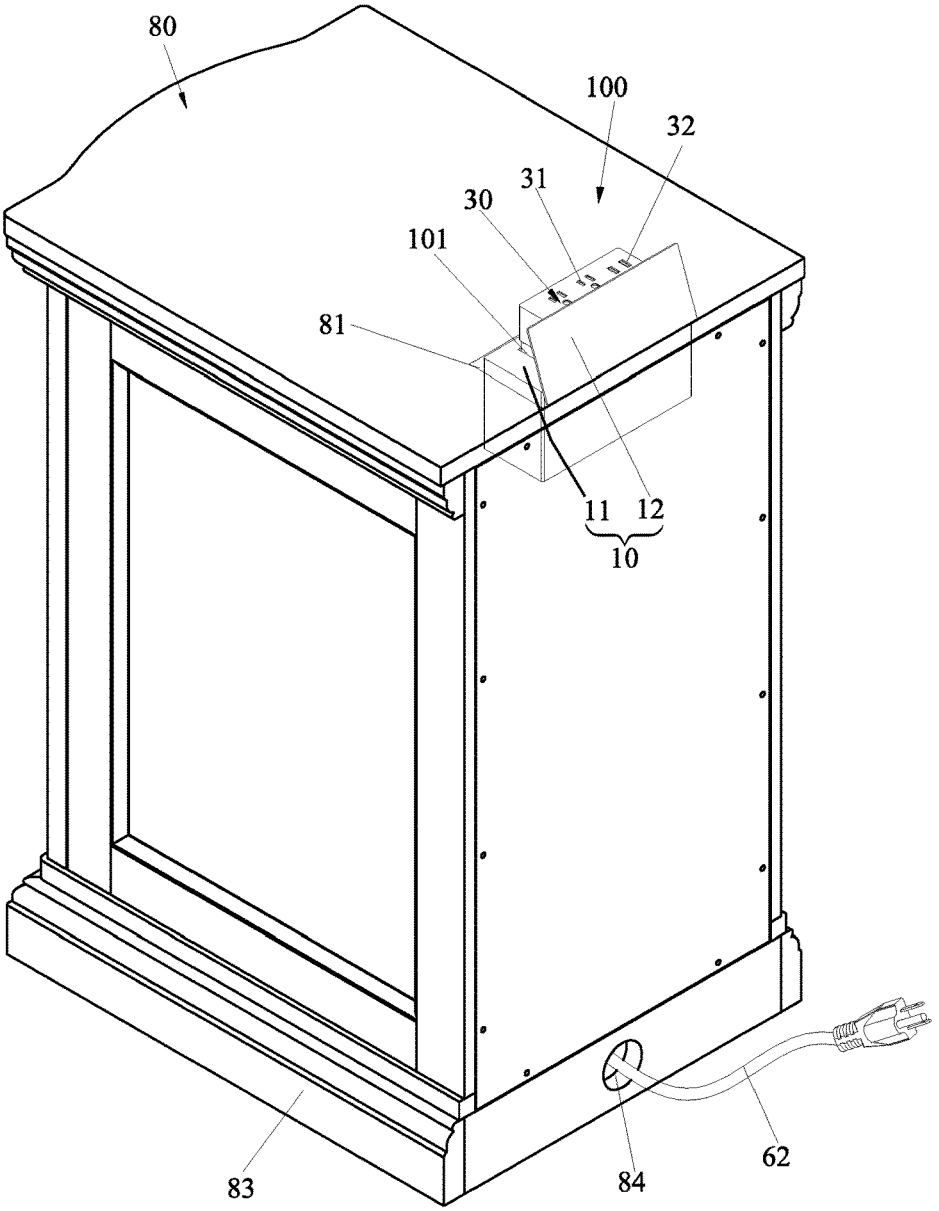
FIG. 2 is another perspective view of the table cabinet according to the preferred embodiment of the present invention.
Figure 3:
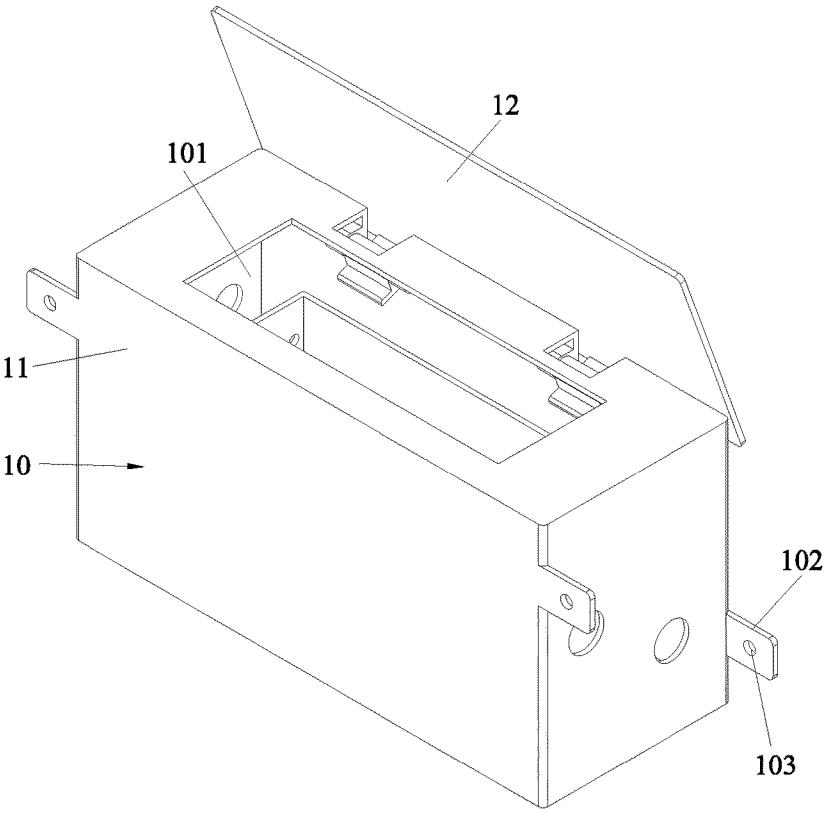
FIG. 3 is an enlarged view of the housing according to the preferred embodiment of the present invention.
Figure 4:
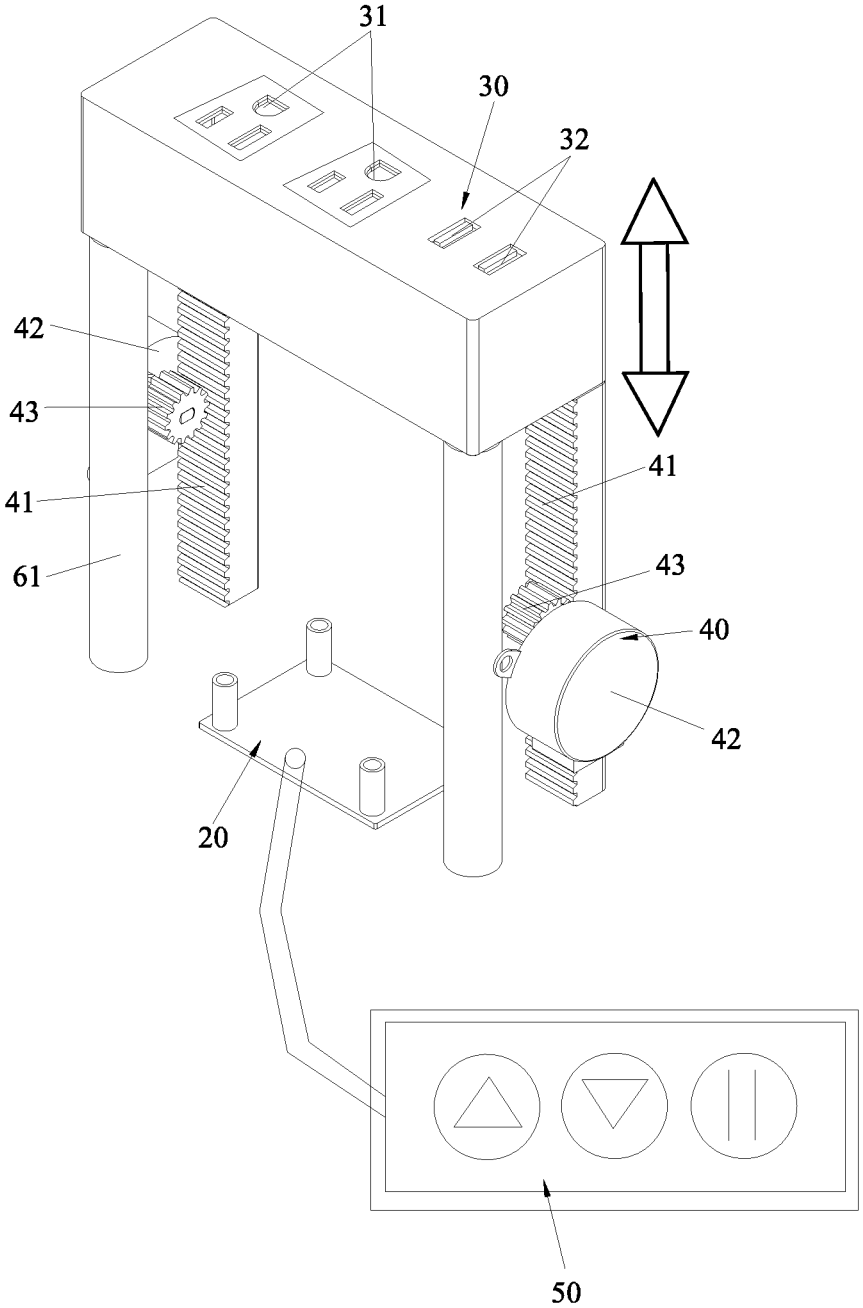
FIG. 4 is a schematic view showing the internal structure of the power-driven lifting socket according to the preferred embodiment of the present invention.
Figure 5:
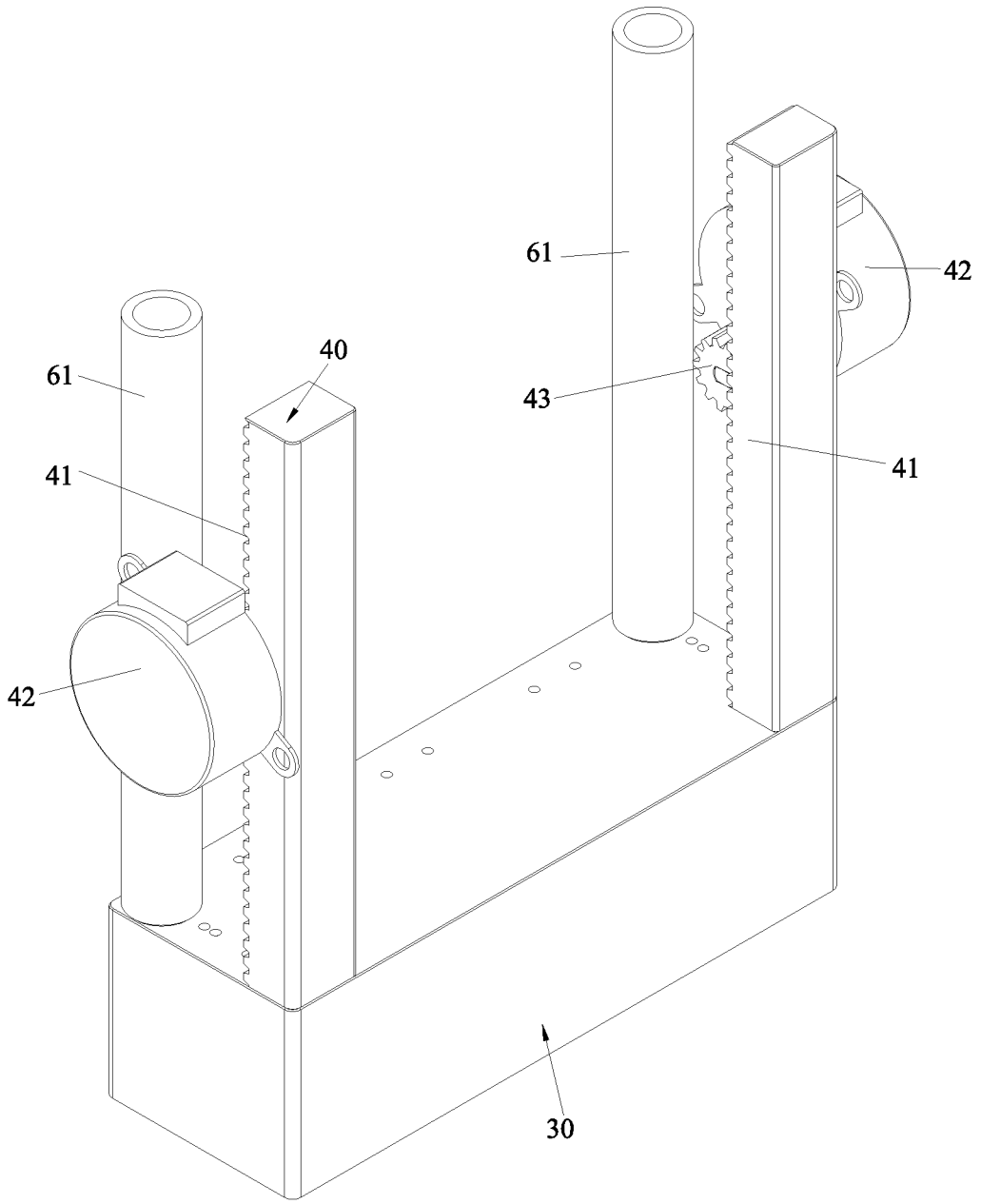
FIG. 5 is another schematic view showing the internal structure of the power-driven lifting socket according to the preferred embodiment of the present invention.
Figure 6:
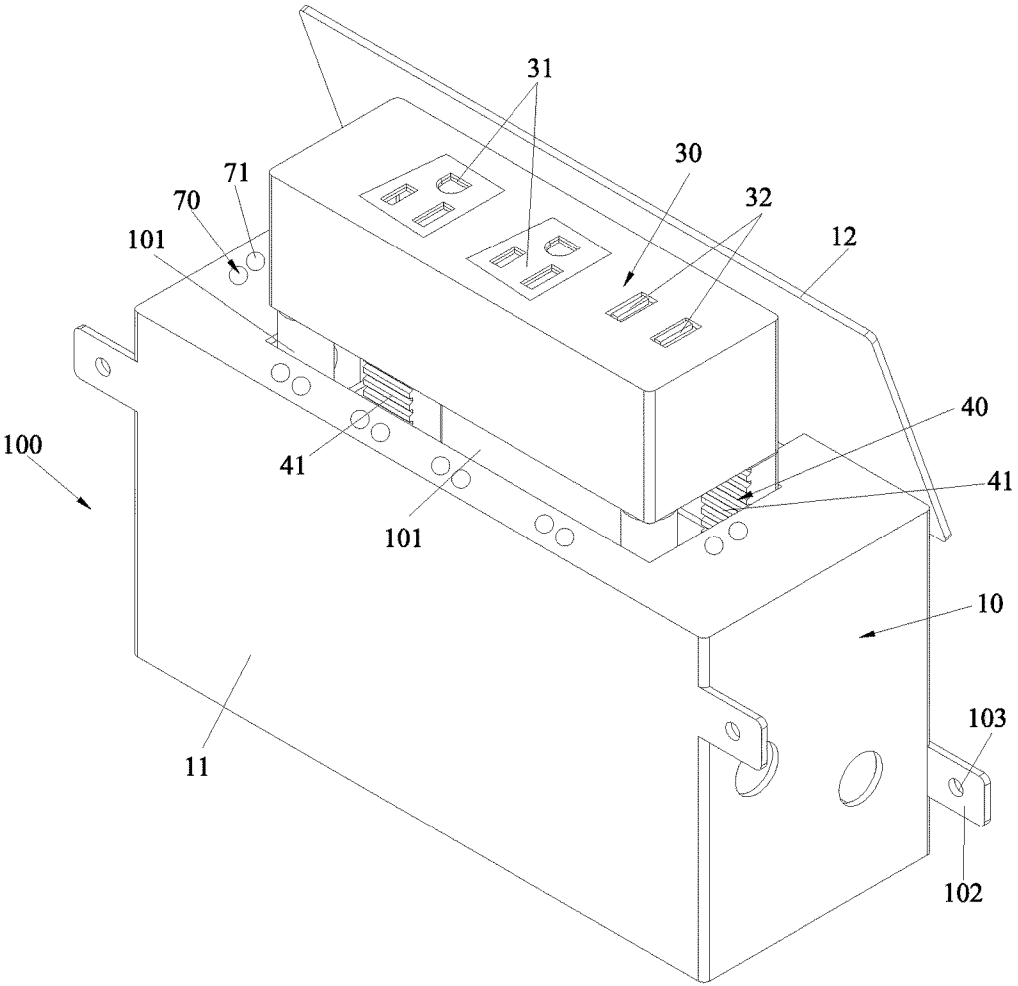
FIG. 6 is a perspective view of the power-driven lifting socket according to the preferred embodiment of the present invention.
Figure 7:
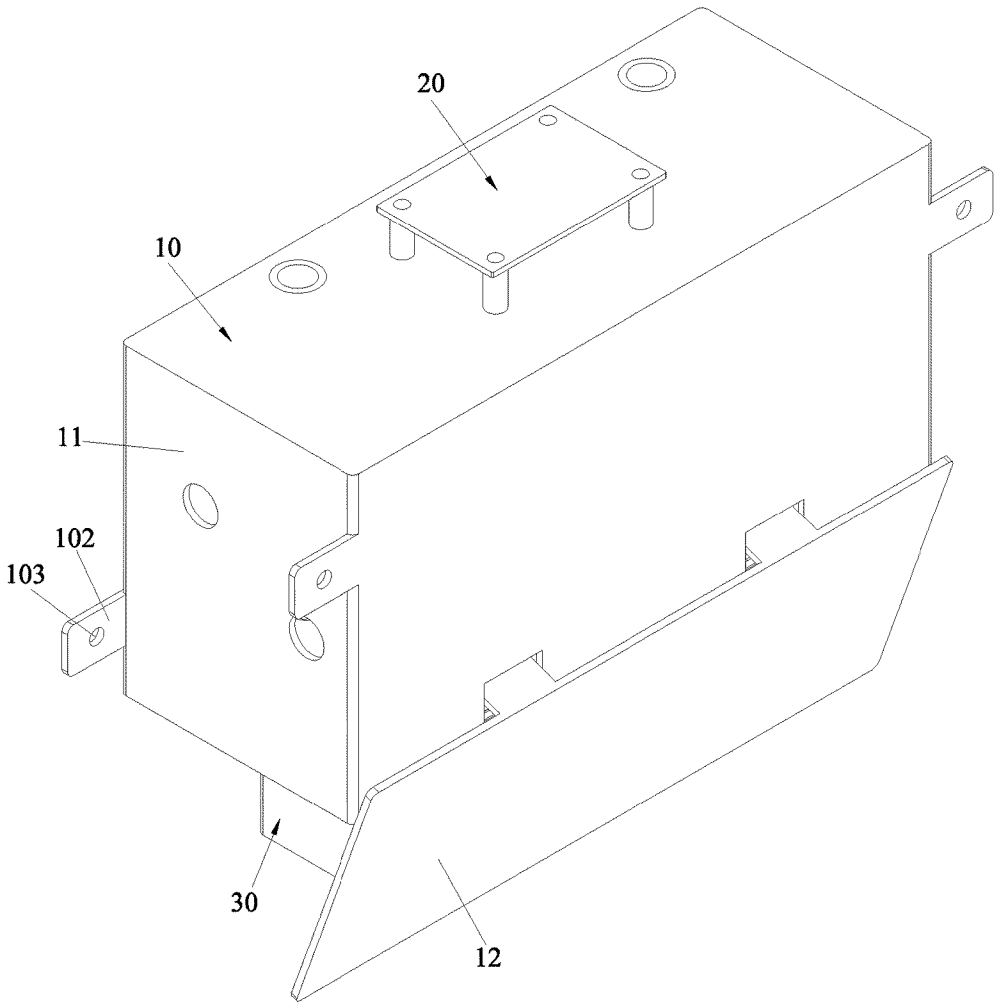
FIG. 7 is another perspective view of the power-driven lifting socket according to the preferred embodiment of the present invention.
Figure 8:
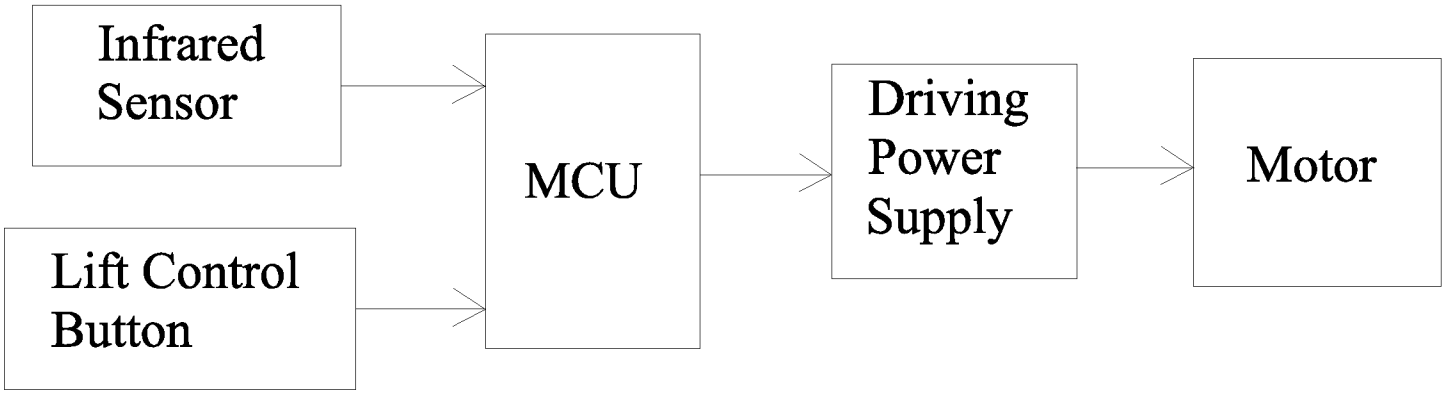
FIG. 8 is a block diagram of the control principle of the power-driven lifting socket according to the preferred embodiment of the present invention.

The present invention further discloses a table cabinet having a power-driven lifting socket, as shown in FIG. 1 and FIG. 2, comprising a table cabinet main body 80 and the aforesaid power-driven lifting socket 100. A surface of the table cabinet main body 80 is recessed to form a mounting trough 81. The power-driven lifting socket 100 is disposed in the mounting trough 81. In a lifting state, the socket main body 30 opens the flip-open cover 12 and extends out of the surface of the cabinet main body 80. In a hidden state, the flip-open cover 12 covers the socket main body and is flush with the surface of the table cabinet main body 80.

In this embodiment, the table cabinet main body 80 is made of a wood, plastic or metal material. The front of the table cabinet main body 80 is provided with a door 82 that can be opened and closed. The other sides of the table cabinet main body 80 are hermetically disposed. The bottom of the table cabinet main body 80 is provided with a flat support base or at least two spaced support legs. The table cabinet main body 80 has a perforation 84. The power cord 62 is led out from the perforation 84.

The working principle of this embodiment is as follows:

When in use, the lift control button 50 is pressed, and then the motor 42 drives the gear 43 to rotate for the rack 41 to be moved upward. The socket main body 30 is moved upward along the passage 101 under the action of the rack 41 to open the flip-open cover 12 so that the socket main body 30 is exposed to the surface of the table cabinet main body 80 for use. When there is no need to use the socket main body 30, the corresponding lift control button 50 is pressed, and then the motor 42 drives the gear 43 to rotate in the reverse direction so that the rack 41 is moved downward. The socket main body 30 is moved downward along the passage 101 under the action of the rack 41, such that the socket main body 30 is retracted into the passage 101. When the downward movement is completed, the flip-open cover 12 covers the passage 101 and is flush with the surface of the table cabinet main body 80 so as to hide the socket main body 30 and make the surface of the table cabinet main body 80 tidy and beautiful.

The feature of the present invention is that the socket main body can be driven by the lifting device to move up and down so as to extend out of the passage or retract into the passage. The socket main body may ascend or descend according to the need of use. When not in use, the socket main body can be hidden, such that the surface of the table cabinet main body is tidy and beautiful, and the socket main body won't be contaminated by the dust, thereby ensuring the performance for the socket. Besides, children can be prevented from touching and the potential safety hazard can be eliminated, which brings convenience to users.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A power-driven lifting socket, comprising a housing, a control board, a socket main body and a lifting device; the housing including a base and an openable cover, the base having a passage with an opening facing upward, the openable cover being mounted on a top of the base and configured to cover the opening at an upper end of the passage; the control board being disposed on a bottom of the base; the socket main body being disposed in the passage; the lifting device being disposed in the passage and structured to drive the socket main body to move in the passage so as to extend out of the passage or retract into the passage, the lifting device being electrically connected to the control board and comprising a rack, a motor and a gear, wherein the rack is fixed to the socket main body and extends downward; the motor is fixed in the passage and electrically connected to the control board; and the gear is mounted on an output shaft of the motor and engages with the rack such that operation of the motor drives, through the output shaft and the mating engagement between the rack and the gear to selectively causes the socket main body that is fixed with the rack to move in the passage.

2. The power-driven lifting socket as claimed in claim 1, wherein the lifting device includes two lifting devices arranged at two opposite ends of the socket main body, and the racks of the two lifting devices are fixedly connected to a bottom of the two ends of the socket min body, respectively.

3. The power-driven lifting socket as claimed in claim 1, wherein the motor is one of a stepper motor, a synchronous motor and a direct current motor.

4. The power-driven lifting socket as claimed in claim 1, wherein the housing is provided with a protection device for preventing a user's hand from being pressed, and the protection device is electrically connected to the control board.

5. The power-driven lifting socket as claimed in claim 4, wherein the protection device includes an infrared sensor, and the infrared sensor is disposed at a lower portion of the socket main body or a lower portion of a socket mounting port.

6. The power-driven lifting socket as claimed in claim 1, wherein a bottom of the socket main body is provided with a support post, the socket main body is connected with a power cord, and the power cord is partially hidden in the support post.

7. The power-driven lifting socket as claimed in claim 1, wherein the socket main body has one of a mains electricity supply interface and a universal serial bus (USB) charging interface or a combination thereof.

8. A table cabinet having a power-driven lifting socket, comprising a table cabinet main body and the power-driven lifting socket as claimed in claim 1; a surface of the table cabinet main body being recessed to form a mounting trough, the power-driven lifting socket being disposed in the mounting trough, wherein in a lifting state, the socket main body opening the openable cover and extending out of the surface of the cabinet main body; and in a hidden state, the openable cover covering the socket main body and being flush with the surface of the table cabinet main body.

9. The table cabinet with the power-driven lifting socket as claimed in claim 8, wherein the table cabinet main body is made of a wood, plastic or metal material, a front of the table cabinet main body is provided with a door that can be opened and closed, and other sides of the table cabinet main body are hermetically disposed.

* * * * *